US008833897B2

(12) United States Patent
Murata et al.

(10) Patent No.: US 8,833,897 B2
(45) Date of Patent: Sep. 16, 2014

(54) INKJET DEVICE AND CONTROLLING METHOD FOR INKJET DEVICE

(71) Applicant: Toshiba Tec Kabushiki Kaisha, Tokyo (JP)

(72) Inventors: Hiroshi Murata, Tokyo (JP); Masashi Hiroki, Kanagawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/846,226

(22) Filed: Mar. 18, 2013

(65) Prior Publication Data

US 2013/0257941 A1 Oct. 3, 2013

(30) Foreign Application Priority Data

Apr. 3, 2012 (JP) ..... 2012-084537

(51) Int. Cl.

| | |
|---|---|
| ***B41J 29/38*** | (2006.01) |
| ***B41J 2/18*** | (2006.01) |
| ***B41J 2/175*** | (2006.01) |
| *B41J 2/165* | (2006.01) |

(52) U.S. Cl.

CPC .... *B41J 2/16535* (2013.01); *B41J 2002/16573* (2013.01); *B41J 2/16538* (2013.01); *B41J 2/18* (2013.01); *B41J 2/175* (2013.01)

USPC ..... 347/17; 347/33; 347/35

(58) Field of Classification Search

USPC ..... 347/9, 17, 22, 23, 29, 30, 32, 33, 34, 35

See application file for complete search history.

(56) References Cited

U.S. PATENT DOCUMENTS

| | | | | |
|---|---|---|---|---|
| 6,866,362 | B2 * | 3/2005 | Kimura et al. | 347/33 |
| 7,425,525 | B2 | 9/2008 | Akiyama et al. | |
| 7,484,826 | B2 | 2/2009 | Hiroki et al. | |
| 7,803,851 | B2 | 9/2010 | Ishibashi et al. | |
| 8,091,980 | B2 * | 1/2012 | Snyder et al. | 347/35 |
| 8,100,500 | B2 | 1/2012 | Bansyo | |
| 8,215,757 | B2 | 7/2012 | Kuribayashi et al. | |
| 8,235,494 | B2 | 8/2012 | Kaiho et al. | |
| 8,328,309 | B2 | 12/2012 | Izumi et al. | |

* cited by examiner

*Primary Examiner* — Juanita D Jackson

(74) *Attorney, Agent, or Firm* — Patterson & Sheridan LLP.

(57) ABSTRACT

An inkjet recording device includes an inkjet head that is equipped with a nozzle to discharge ink, an ink flow path connected to this inkjet head, an adjustment unit that adjusts the pressure in the ink flow path, and a maintenance unit that wipes the nozzle of the inkjet head, and a control unit that executes a maintenance mode of the inkjet head by controlling the adjustment unit and the maintenance unit. The control unit controls the maintenance unit to wipe the nozzle after the adjustment unit adjusts the pressure inside the ink flow path to a first positive pressure, and then again, after the adjustment unit adjusts the pressure in the ink flow path to a first negative pressure. The control unit further controls the adjustment unit to adjust the pressure in the flow path to a second negative pressure that is smaller than the first negative pressure.

20 Claims, 8 Drawing Sheets

INKJET DEVICE AND CONTROLLING METHOD FOR INKJET DEVICE

CROSS-REFERENCE TO RELATED APPLICATION

This application is based upon and claims the benefit of priority from Japanese Patent Application No. 2012-084537, filed on Apr. 3, 2012; the entire contents of which are incorporated herein by reference.

FIELD

Embodiments described herein relate generally to an inkjet device and a controlling method for the inkjet device.

BACKGROUND

Regular maintenance is carried out on an inkjet head of an inkjet recording device, including removal of highly viscous ink that has adhered to a nozzle of the inkjet head. Highly viscous ink is produced when the solvent in the ink that has adhered to the nozzle evaporates. Such highly viscous ink is removed by circulating ink through the nozzle while applying negative pressure thereon. The highly viscous ink may also be removed by purging the ink being ejected from the inkjet head.

DETAILED DESCRIPTION

Figure 1:
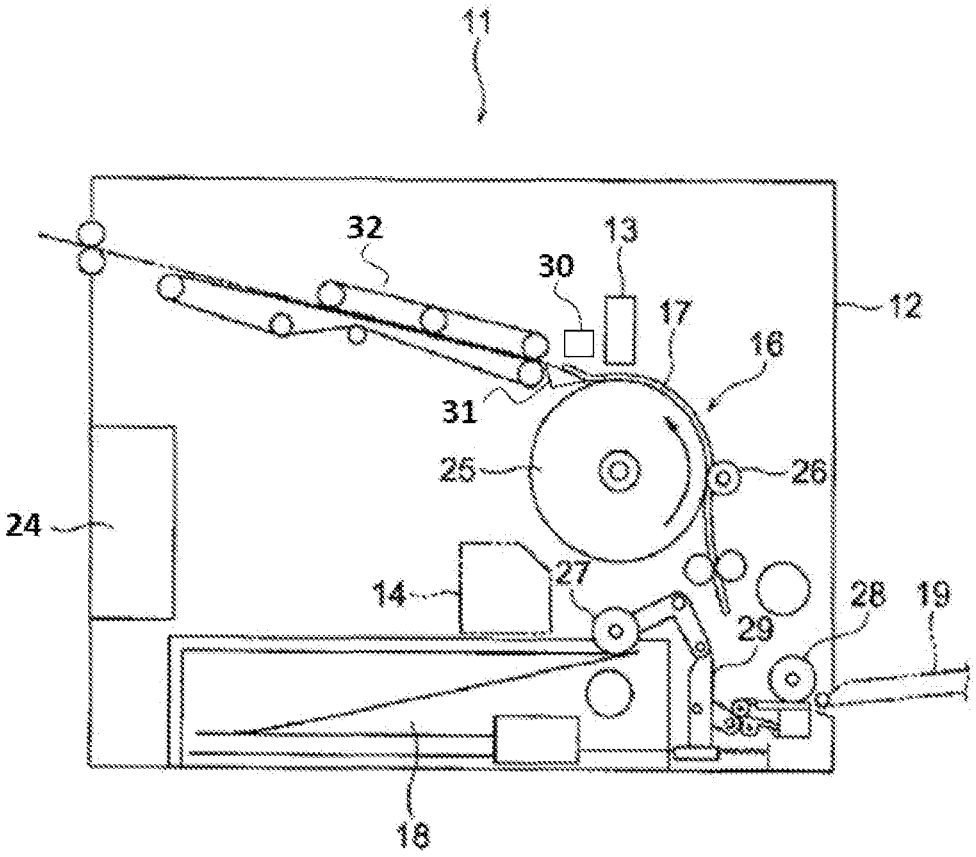
FIG. 1 is a block diagram of an inkjet recording device of a first embodiment.

In general, embodiments will be described with reference to the drawings. In the drawings, the same reference numerals used across different figures denote the same or similar portions.

A first embodiment will be described with reference to FIG. 1 through FIG. 8. FIG. 1 is a block diagram of the inkjet recording device. An inkjet recording device 11 is equipped with a main body case 12, an inkjet head 13 (recording head), an ink supply device 14, a maintenance device 30, a control unit (controller) 24, a sheet feed mechanism 16, a paper feed cassette 18, and a manual feed tray 19. A sheet is a recording medium that can record an image on its surface with ink, and includes a pulp or resin sheet.

The sheet feed mechanism 16 includes a drum 25, a charging roller 26, a first feed roller 27, a second feed roller 28, a drive switching mechanism 29, a detachment claw 31, and a paper eject mechanism 32. The paper feed cassette 18 can store multiple sheets inside. The first feed roller 27 feeds the sheets stacked in the paper feed cassette 18 one at a time in the direction of the drum 25. The manual feed tray 19 receives loading of sheets from the outside of the inkjet recording device 11. The second feed roller 28 feeds the sheets on the manual feed tray 19 one at a time in the direction of the drum 25. The drive switching mechanism 29 transfers power to either the first feed roller 27 or the second feed roller 28.

The drum 25 is rotatably supported and is positioned in a location that faces the inkjet head 13. The charge roller 26 charges the surface of the drum 25. The drum 25 adsorbs a sheet 17 to its surface with the electrical charge and fixes the sheet 17 thereon. The drum. 25 is configured to stably feed the sheet 17 to the location of the inkjet head 13.

The detachment claw 31 is a claw to detach the sheet 17 from the surface of the drum 25. The paper eject mechanism 32 transports the sheet 17 that is detached by the detachment claw 31 to the outside of the main body case 11.

Figure 2:
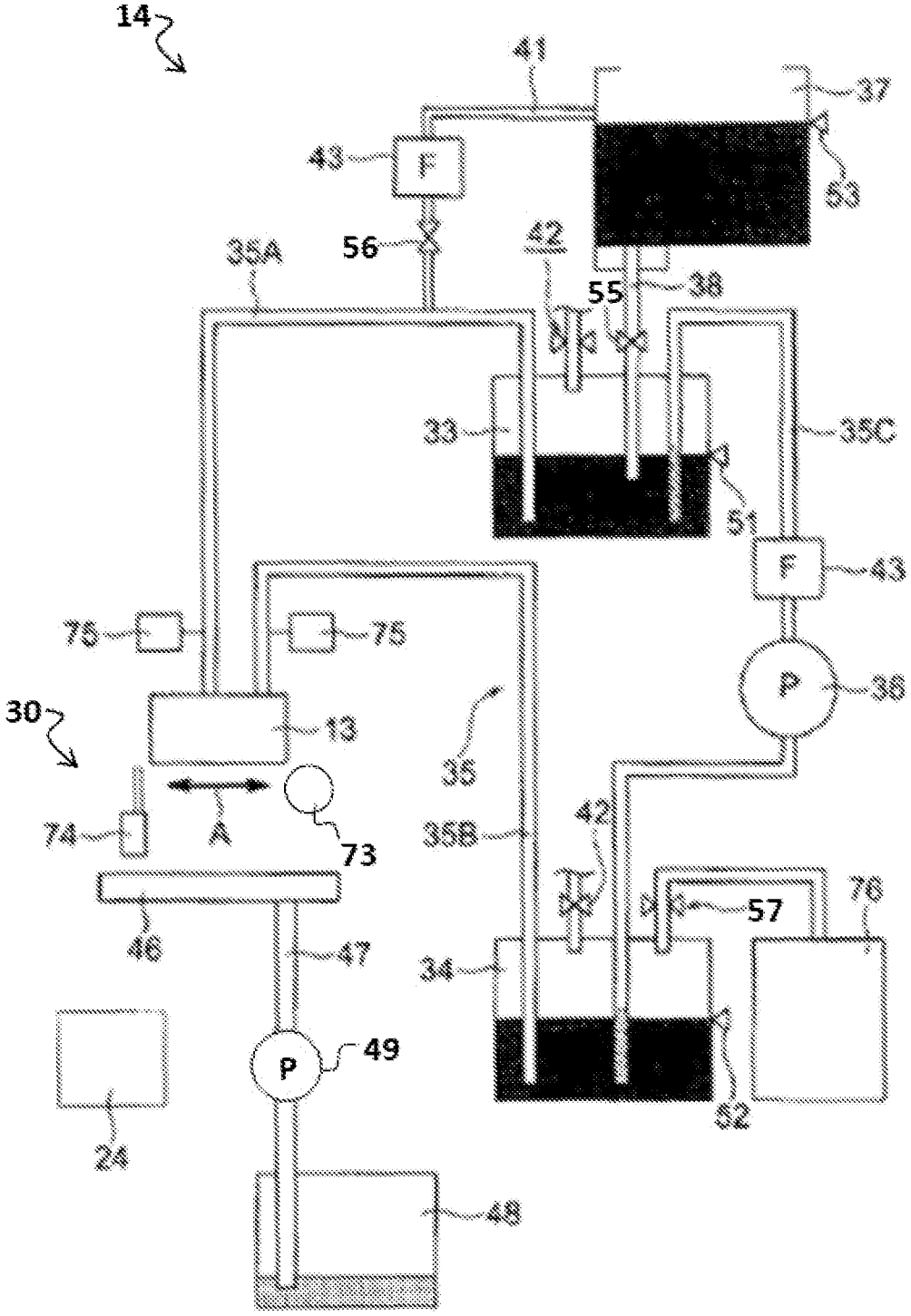
FIG. 2 is a block diagram of an ink supply device of the first embodiment.

FIG. 2 is a block diagram of the ink supply device 14. The ink supply device 14 includes a main tank 37, a first tank 33, a second tank 34, a main flow path 35, a pump 36, a pressure adjustment valve 42, a filter unit 43, a supply flow path 38, a recovery flow path 41, a pressure sensor 75, a pressure adjustment unit 76, valves 55, 56, 57, and the maintenance device 30. The volume of the main tank 37 is larger than the volume of either the first tank 33 or the second tank 34. The pressure adjustment valve 42, and valves 55, 56, and 57 are solenoid valves. These solenoid valves are controlled by a control circuit described below.

The main tank 37 stores replenishment ink therein. The ink is a liquid ink that includes color particles used in forming an image on the sheet 17, but it is not limited to this, and can include an ink solvent or a solid ink with a low melting point.

The main tank 37 supplies ink through the supply flow path 38 to the first tank 33. This main tank 37 is not sealed and the interior has the same barometric pressure as that of the outside. A fluid level sensor 53 detects the height of the fluid level of the ink of the main tank 37. The supply flow path 38 connects the main tank 37 and the first tank 33. The valve 55 that is attached to the supply flow path 38 controls the supply of the ink from the main tank 37 to the first tank 33. The first tank 33 is placed vertically below the main tank 37. When the valve 55 is opened, due to the atmospheric pressure and gravity, the ink is supplied from the main tank 37 to the first tank 33.

The recovery flow path 41 connects the main tank 37 and a main flow path 35A. The recovery flow path 41 is equipped with the filter unit 43 and the valve 56. The valve 56 is normally closed, and is opened when recovering the ink from the main flow path 35A. The filter unit 43 removes foreign particles in the ink. The filter unit 43 is equipped with a mesh filter and a housing that surrounds this filter.

The first tank 33 is connected to the inkjet head 13 via the main flow path 35A. The inkjet head 13 is connected to the second tank 34 via a main flow path 35B. The second tank 34 is connected to the first tank 33 via the main flow path 35C. With this configuration, the ink circulates through the main flow path 35, the first tank 33, and the second tank 34.

The first tank 33 is equipped with a fluid level sensor 51 and the pressure adjustment valve 42. The fluid level sensor 51 detects the height of the fluid level of the ink of the first tank 33. By opening the pressure adjustment valve 42, the interior of the first tank 33 is adjusted to the atmospheric pressure. The pressure adjustment valve 42 is normally closed.

The main flow paths 35A and 35B are each equipped with pressure sensors 75A and 75B. The pressure sensors 75A and 75B are placed in the neighborhood of the inkjet head 13. The pressure sensor 75A detects the pressure of the ink in the main flow path 35A. The pressure sensor 75B detects the pressure of the ink in the main flow path 35B.

The second tank 34 includes a fluid level sensor 52, the pressure adjustment valve 42, the valve 57, and the pressure adjustment unit 76. The fluid level sensor 52 detects the height of the fluid level of the ink of the second tank 34. By opening the pressure adjustment valve 42, the interior of the first tank 33 is adjusted to the atmospheric pressure. The pressure adjustment valve 42 is normally closed.

The pressure adjustment unit 76 is configured to adjust the atmospheric pressure inside the second tank 34. The pressure adjustment unit 76 is configured to send air into, and to suck air out of the second tank 34. When the pressure adjustment unit 76 is in operation, the pressure adjustment valve 42 is closed.

The main flow path 35C is equipped with the pump 36 and the filter unit 43. The pump 36 includes a function to supply ink from the second tank 34 to the first tank 33. The filter unit 43 removes foreign particles in the ink.

The fluid level sensors 51 and 52 mentioned above supply signals to a control circuit 15 mentioned below. The control circuit 15 controls the valve 55 according to signals from the fluid level sensors 51 and 52. The fluid levels of the first and the second tanks 33 and 34 are controlled to be at a higher position than the corresponding end part of the main flow path 35, so that air is not introduced into the main flow path 35, and the main flow path 35 is filled with ink. With this arrangement and control and through the capillary vessel phenomenon, the ink circulates inside the main flow path 35.

The maintenance device 30 is equipped with an ink tray 46, a discharge flow path 47, a discharge tank 48, a pump 49, a head wiper 74, and an ink roller 73. The ink tray 46 receives ink that is emitted from the inkjet head 13. The ink accumulated in the ink tray 46 is sucked into the discharge flow path 47 by the pump 49 and stored in the discharge tank 48.

The ink roller 73 is a felt roller in one embodiment, and is impregnated with ink. A blade or a spray can also be used instead of the ink roller 73. The ink roller 73 is configured to apply ink to the nozzle surface. By a drive mechanism (not shown in the diagram), the ink roller 73 moves reciprocally in the arrow A direction shown in FIG. 2 while being in contact with the nozzle surface of the inkjet head.

The head wiper 74 may be a rubber blade or a sponge roller. The head wiper 74 moves reciprocally in the arrow A direction shown in the figure while being in contact with the nozzle surface of the inkjet head 13, by a drive mechanism not shown in the diagram.

Figure 3:
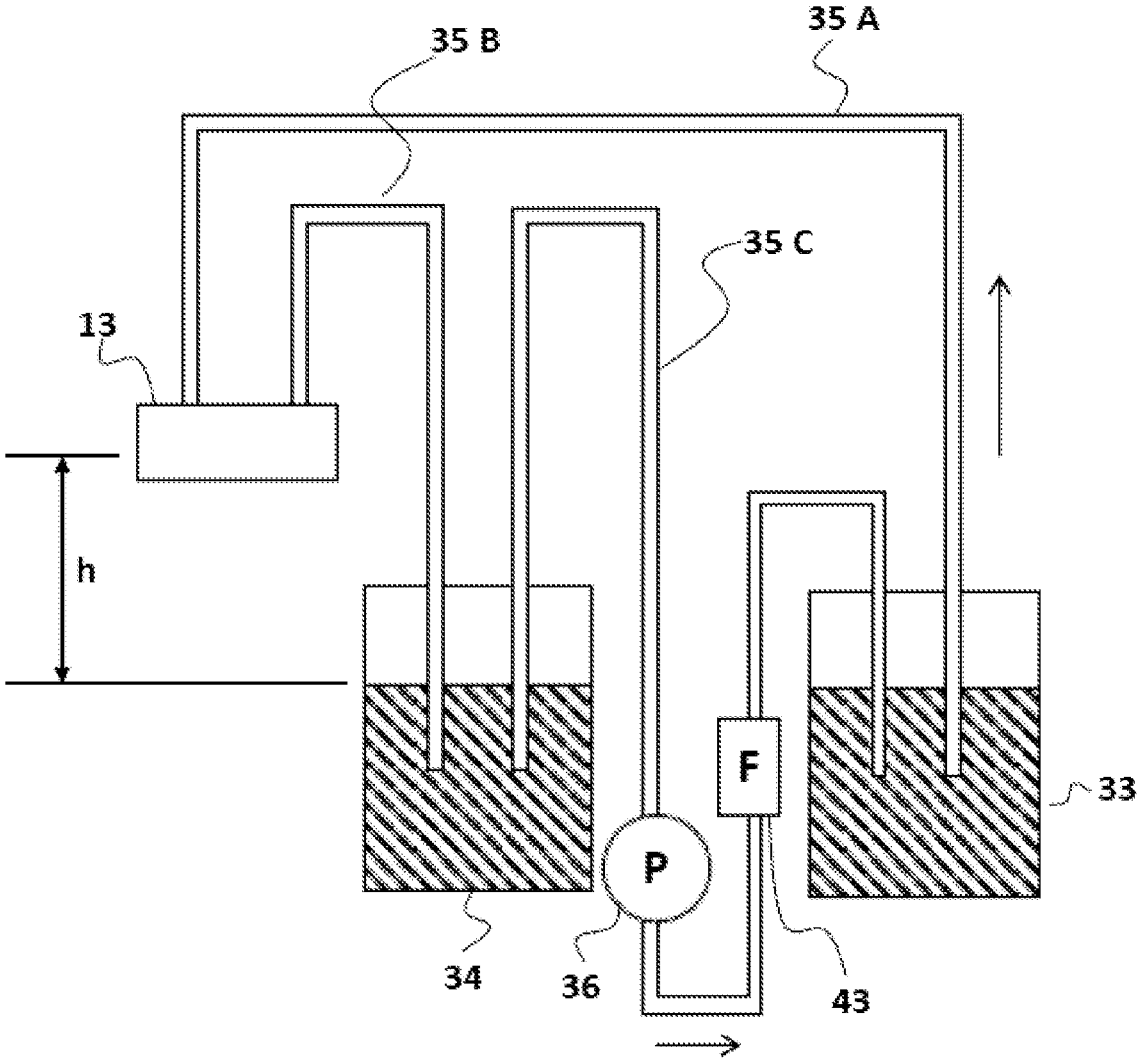
FIG. 3 is a diagram showing relative positions of various components of the ink supply device of the first embodiment.

FIG. 3 is a diagram that shows relative positions of various components of the ink supply device 14. The inkjet head 13 is placed in a location that is "h" cm higher than the fluid level height of the second tank 34. Therefore, a difference in the hydraulic head occurs between the ink fluid level inside the inkjet head 13 and the fluid levels of the first tank 33 and the second tank 34. For this reason, the ink inside an ink storage chamber 62 in the inkjet head has a negative pressure. The pressure of the ink in the ink storage chamber 62 is controlled to be constant in a range of, for example, 0 through −3.0 kPa.

In the first embodiment, the fluid levels of the first tank and the second tank are the same height. The control circuit 15 drives the pump 36 so that the fluid level of the first tank and the fluid level of the second tank will be at the same height.

Figure 4:
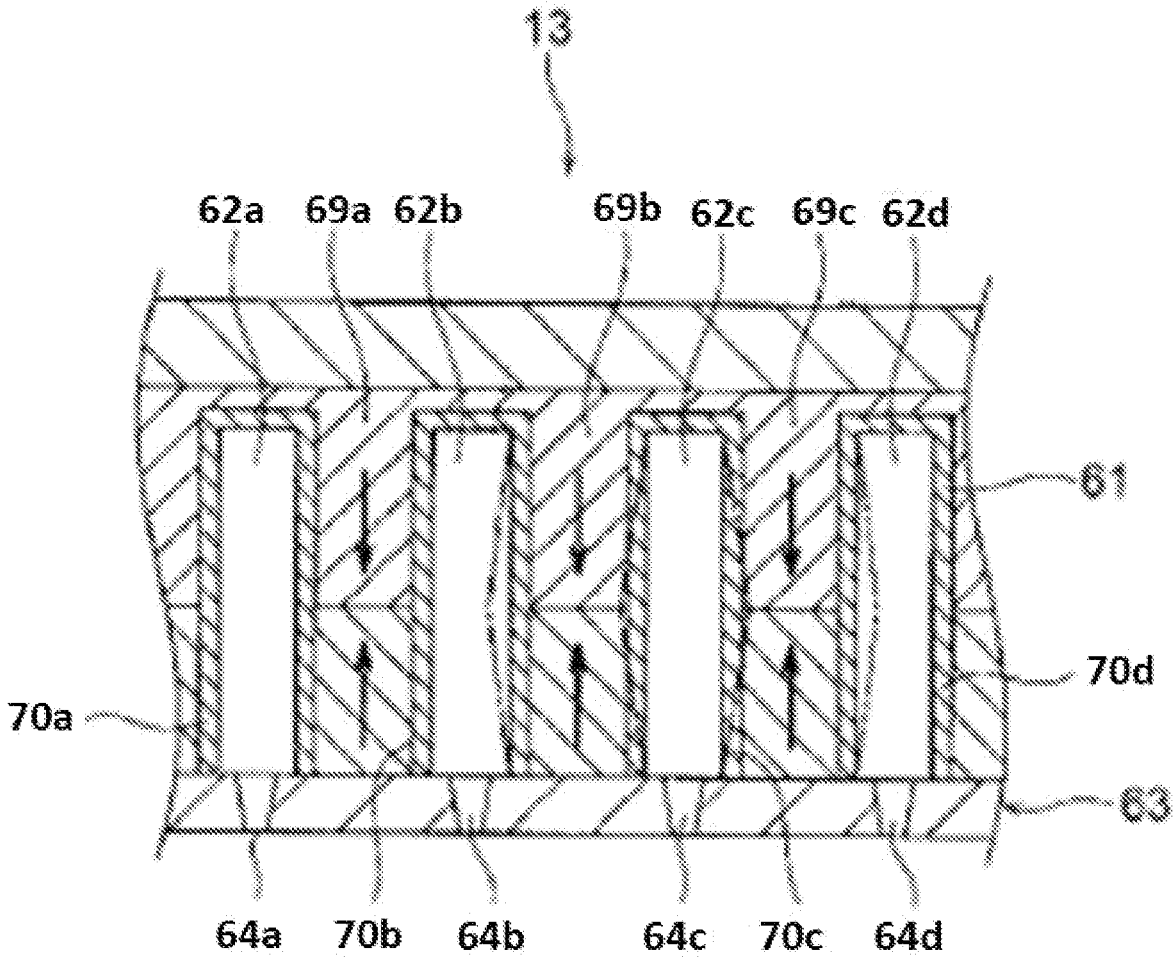
FIG. 4 is a block diagram of the inkjet head of the first embodiment.

FIG. 4 is a block diagram of the inkjet head. The inkjet head 13 is made of piezoelectric material, and includes such materials of a share mode type and a side shooter type. The head main body 61 of the inkjet head 13 is equipped with multiple ink storage chambers 62 (62*a*, 62*b*, 62*c*, 62*d*), a nozzle plate 63, a drive element 69 (69*a*, 69*b*, 69*c*), and an electrode 70 (70*a*, 70*b*, 70*c*, 70*d*).

The nozzle plate 63 is equipped with multiple nozzles 64 (64*a*, 64*b*, 64*c*, 64*d*). These multiple nozzles 64 are formed in equal intervals in the central part of the nozzle plate 63. The electrode 70 is placed in a location that corresponds to the nozzle 64 on one surface of the nozzle plate 63. The ink storage chamber 62 is formed by the nozzle plate 63 and the electrode 70. The nozzle 64 has a conical shape with a diameter at the outer side of the nozzle plate 63 that is smaller compared to that at the ink storage chamber 62 side.

Each of the ink storage chambers 62 is connected to each other, and is supplied with ink from the main flow path 35A. The ink inside the ink storage chamber 62 flows out to the second tank 34 via the main flow path 35B.

A drive element 69 is placed in between the multiple electrodes 70. The drive element 69 is formed by bonding together two plate-shaped piezoelectric members made of PZT (lead zirconium titanate). These two piezoelectric members are bonded so that their polarization directions are opposite to each other.

The multiple ink storage chambers 62 are filled with ink. In the case where the ink inside the main flow path 35 maintains negative pressure, the ink inside the ink storage chamber 62 is not discharged from the nozzle 64. In the first embodiment, the ink pressure at the time of printing is set to have a first negative pressure value (−1.0 kPa). In the case where the ink inside the main flow path 35 is changed to a positive pressure, the ink is discharged from the nozzle 64 without applying voltage to the electrode 70.

Below, the case in which a set voltage is applied to electrodes 70*b* and 70*d* is explained. The ink inside the main flow path 35 maintains a negative pressure. If a drive pulse voltage is applied to the electrodes 70*b* and 70*d*, an electrical field is generated between the electrode 70*b* (70*d*) and the electrode 70*c*. With this electrical field, the drive elements 69*b* and 69*c* curves as shown by the dotted lines in FIG. 4 (share mode deformation). The volume of an ink storage chamber 62*c* increases as a result. When the supply of the drive pulse voltage to the electrodes 70*b* and 70*d* is stopped, the drive elements 69*b* and 69*c* go back to their initial positions, and the volume of the ink storage chamber 62*c* returns to its initial value. The ink inside the ink storage chamber 62*c* is rapidly pressurized, and ink droplets are discharged from the nozzle 64.

When ink droplets are discharged from the nozzle 64 many times, mist is generated around the nozzle 64. This mist adheres to the nozzle plate 63. Much of the mist that adheres to the nozzle plate 64 aggregate and become attached liquid. As a consequence, the discharge direction of the ink is bent or the discharge of the ink is inhibited by the attached liquid. If the attached liquid is neglected, the ink solvent within the attached liquid evaporates and the viscosity of the attached liquid increases. If the nozzle plate 64 is not cleaned, the attached liquid becomes larger and will have an adverse effect on the discharge of the ink.

In the first embodiment, in the case where the inkjet recording device 11 is neglected for a long time without being driven, a maintenance mode is carried out. The maintenance mode includes, for example, an ink application step, an ink wiping step, and an ink suction step. In the ink application step, the ink that solidified in the vicinity of the nozzle is re-dissolved by applying the ink onto the surface of the nozzle. In the ink wiping step, the ink on the nozzle surface is wiped off by the head wiper 74. In the ink suction step, a large negative pressure is applied in the nozzle plate (inside the ink storage chamber 62 that includes the nozzle).

Figure 5:
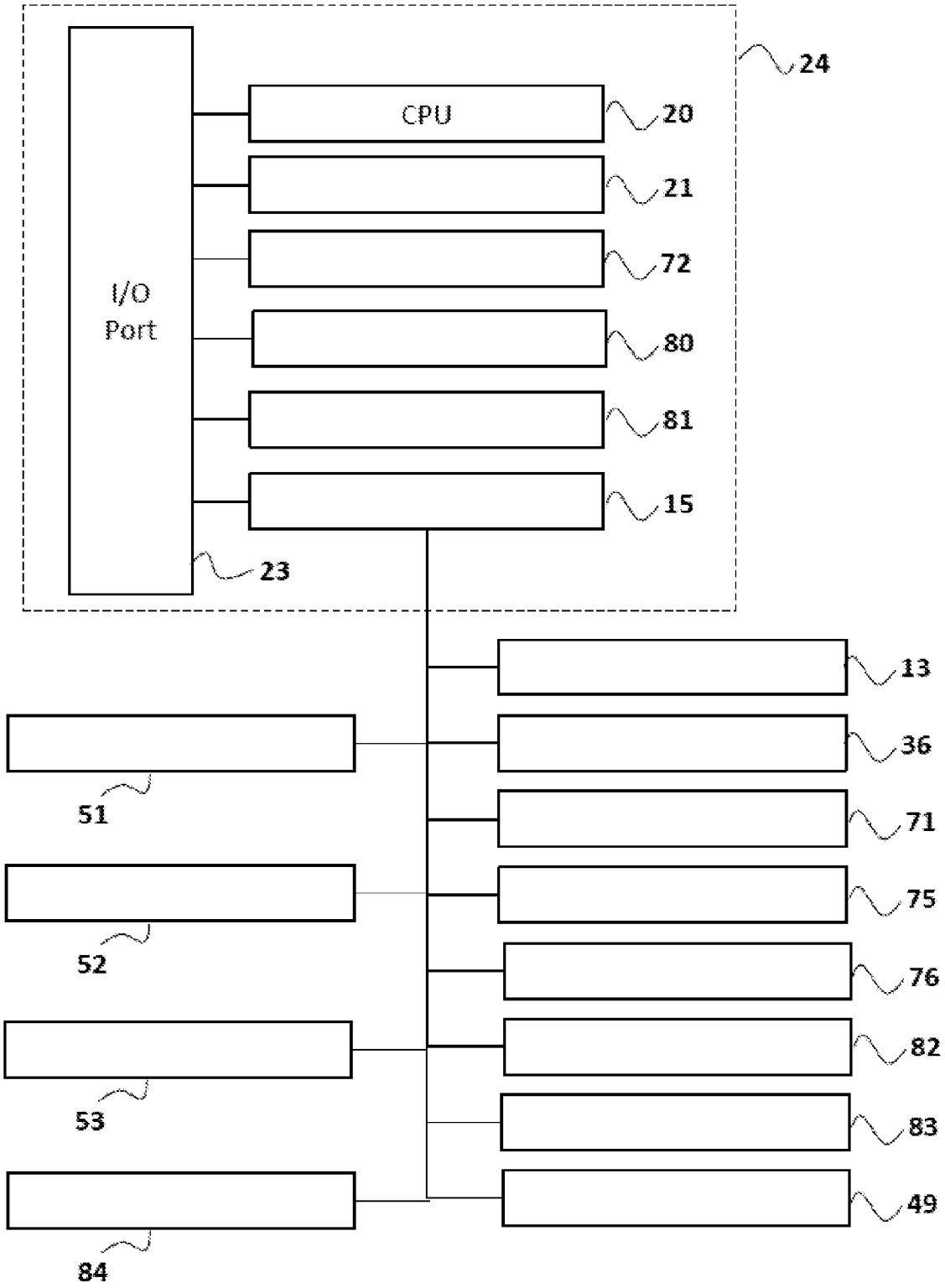
FIG. 5 is a control block diagram of the inkjet recording device of the first embodiment.

FIG. 5 is a control block diagram of the inkjet recording device. The controller 24 of the inkjet recording device is equipped with a CPU 20, an operation panel 21, a memory 72, an external interface 80, a feed control circuit 81, and the control circuit 15. The controller 24 controls the inkjet recording device based on the operator instructions from the operating panel 21 and the printing instructions that are sent from an external device via an external interface 80. Each device is mutually connected by an I/O port 23. The CPU 20 controls the inkjet recording device 11 by executing a program. The memory 72 includes a Random Access Memory (RAM), a Read Only Memory (ROM), and an Hard Disk Drive (HDD). The RAM is used as the work area for executing the control program. The RAM temporarily stores an image data that is printed by the inkjet head 13. The ROM contains various control programs.

The operating panel 21 is a device that accepts input of instructions from the operator. The operating panel 21 transmits the inputted instructions to the CPU 20. The external interface 80 connects to an external device via LAN (Local Area Network) or WAN (Wide Area Network), and carries out reception and transmission of image data. The feed control circuit 81 controls the sheet feed mechanism 16. The control circuit 15 controls the inkjet head 13, the ink supply device 14, and the maintenance device 30.

The control circuit 15 is connected to the inkjet head 13, the pump 36, a timer 71, a pressure sensor 75, the pressure adjustment unit 76, a valve control unit 82, a head wiper control circuit 83, the pump 49, and the fluid level sensors 51, 52, and 53. The electrode 70 of the inkjet head 13 is controlled by the control circuit 15. It is also possible for a difference control circuit attached to the inkjet head 13 to execute the control of the multiple electrodes 70.

The timer 71 counts the drive time of each device based on the instructions of the control circuit 15. The pressure sensor 75 detects the ink pressure at the nozzle surface of the inkjet head 13. The control circuit 15 uses the center value of the two pressure values that are output from the pressure sensor 75A and pressure sensor 75B as the ink pressure.

The valve control unit 82 controls the opening and closing of the pressure adjustment valve 42 and the valves 55, 56, and 57. The head wiper control circuit 83 controls the drive mechanism of the head wiper 74. An ink roller control circuit 84 controls the drive circuit of the ink roller 73.

Figure 6:
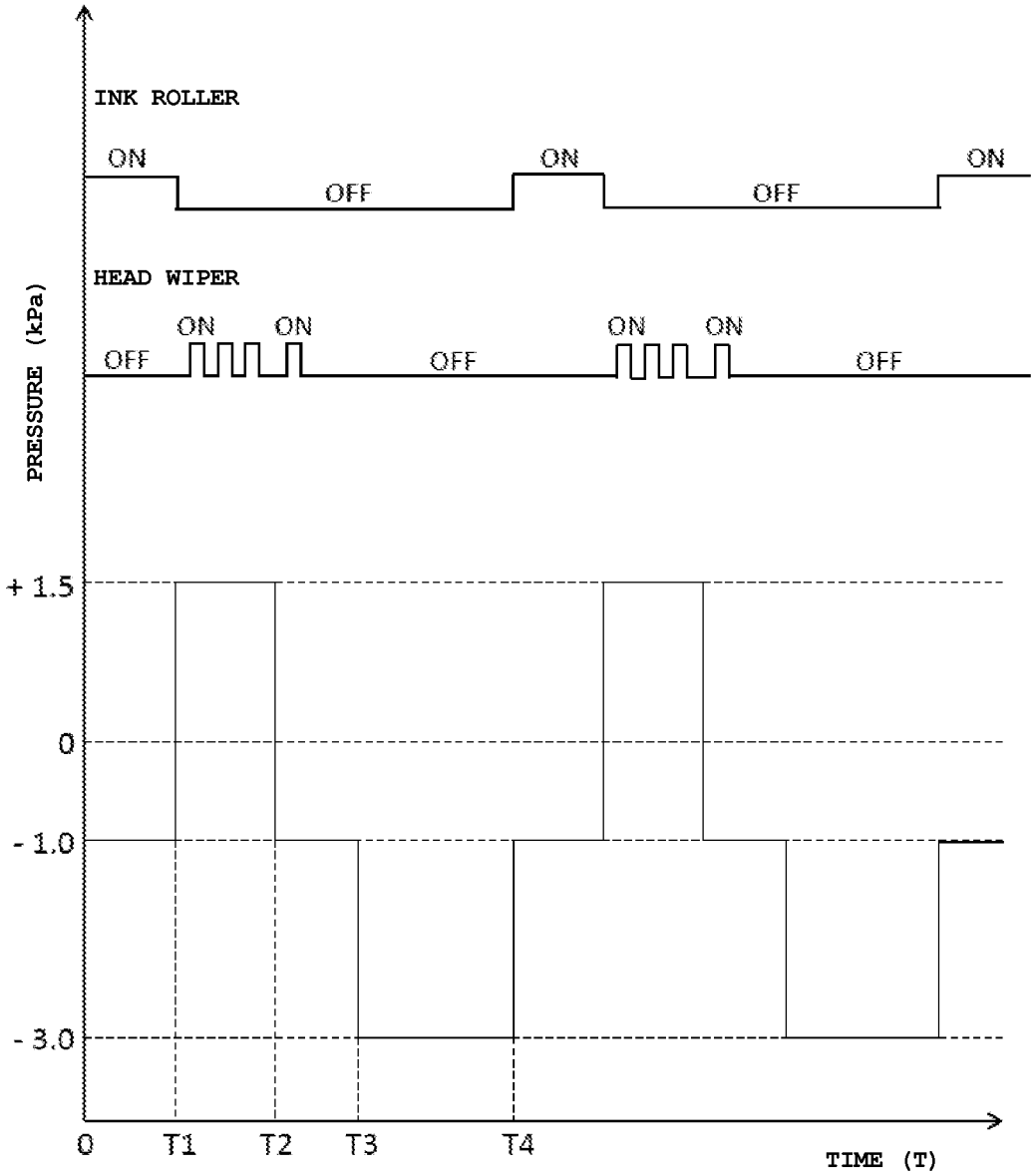
FIG. 6 is a timing chart of the inkjet recording device of the first embodiment in the maintenance mode.

FIG. 6 is a timing chart for the maintenance mode of the inkjet recording device. This maintenance mode is executed at set timings corresponding to when the inkjet recording device 11 finishes a print operation. The controller 24 is able to activate the maintenance mode according to the time elapsed since the time of previous maintenance mode activation, number of printed sheets, and history of external temperature/humidity, and the like. Information such as elapsed time is stored in the memory 72.

In this timing chart, the horizontal axis shows time and the vertical axis shows the pressure sensor 75 value. Also, the drive timings for the ink roller 73 and the head wiper 74 are also shown on the same time axis. ON indicates that each device is being driven, and OFF indicates that each device is halted.

Figure 7:
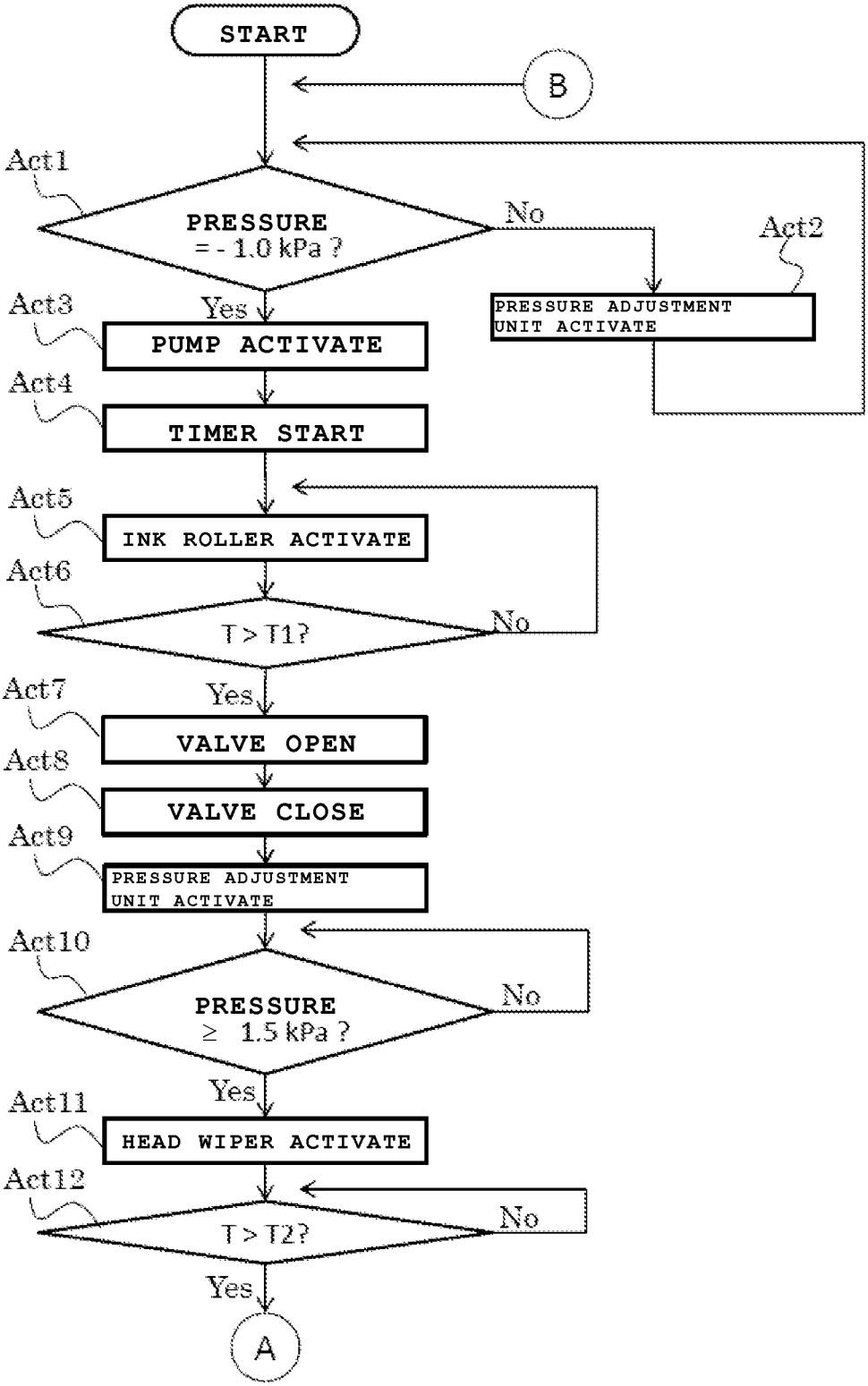
FIG. 7 is a flow chart of a maintenance function executed by the inkjet recording device of the first embodiment.
Figure 8:
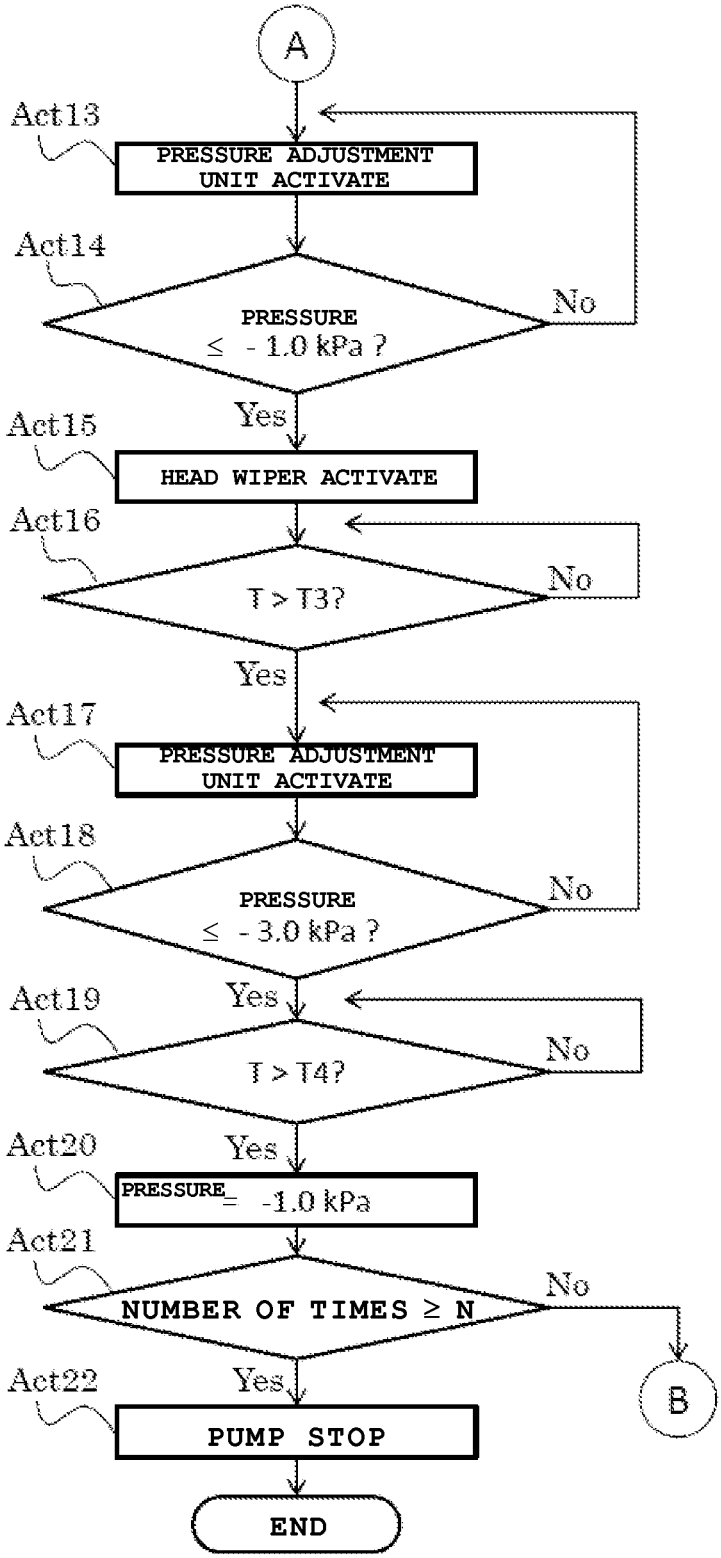
FIG. 8 is a flow chart of another maintenance function executed by the inkjet recording device of the first embodiment.

FIGS. 7 and 8 are flow charts of the maintenance operation of the inkjet recording device. This flow chart is executed by the CPU 20 and the control circuit 15. If the CPU 20 instructs the execution of the maintenance mode, the control circuit 15 reads the value of the pressure sensor 75 and checks whether or not the pressure value is the first negative pressure value (−1.0 kPa) (Act 1). In the case where the pressure value is not the first negative pressure value, the control circuit 15 opens the valve 57 and operates the pressure adjustment unit 76 (Act 2). In the case where the pressure value is the first negative pressure value, the pump 36 begins to operate (Act 3). The ink is circulated with the operation of the pump 36. The control circuit 15 instructs the timer 71 to count the time (Act 4).

The control circuit 15 instructs the ink roller control circuit 84 to operate the ink roller (Act 5). The control circuit 15 operates the ink roller until the timer 71 becomes equal to or more than a preset time T1 (Act 6). In the first embodiment, the processes of Acts 5 and 6 are defined as the first ink application step. The highly viscous ink that has adhered to the nozzle surface has its viscosity lowered by the supply of ink from the ink roller. After a certain amount of time greater than or equal to time T1 has elapsed, the control circuit 15 instructs the valve control unit 82 to open the valve 42 (Act 7). The pressure inside the first tank and the second tank becomes equal to the atmospheric pressure. The control circuit 15 instructs the valve control unit 82 to close the valve 42 (Act 8).

The control circuit 15 then instructs the valve control unit 82 to open the valve 57, and instructs the pressure adjustment unit 76 to operate (Act 9). The control circuit 15 checks the output of the pressure sensor 75, and instructs the pressure adjustment unit 76 to operate until the pressure becomes greater than or equal to the set first positive pressure (+1.5 kPa) (Act 10). When the pressure becomes greater than or equal to the first positive pressure value, the control circuit 15 stops the pressure adjustment unit 76 and instructs the valve control unit 82 to close the valve 57. In the first embodiment, the processes of Act 7 through Act 10 are defined as the second ink application step.

The control circuit 15 instructs the head wiper control unit 83 to drive the head wiper 74 (Act 11). The head wiper 74 cleans the nozzle surface several times. The ink being continuously discharged from the nozzle surface, the highly viscous ink that is adhered to the nozzle surface will have its viscosity lowered further. Additionally, highly viscous ink is removed by the head wiper 74. Until the count value by the timer 71 exceeds the preset time T2, the pressure of the ink will be maintained at the first positive pressure (Act 12). The ink that is discharged from the nozzle surface is received by the ink tray 46 of the maintenance device 30. The ink on the ink tray 46 is sucked into the discharge flow path 47 by the pump 49, and is stored in the discharge tank 48. In the first embodiment, the processes of Act 7 through Act 12 are defined as the second ink application step. Also, Act 11 is defined as the first wipe off step.

When the count value of the timer 71 exceeds T2, the control circuit 15 instructs the pressure adjustment unit 76 to operate (Act 13). The control circuit 15 checks the output of the pressure sensor 75 and instructs the pressure adjustment unit 76 to operate until the pressure becomes less than or equal to the first negative pressure (Act 14). When the pressure becomes less than or equal to the first negative pressure value, the control circuit 15 instructs the head wiper control unit 83 to drive the head wider 74 (Act 15). The head wiper 74 cleans the nozzle surface several times.

Until the count value by the timer 71 exceeds the preset time T3, the pressure of the ink will be maintained at the first negative pressure (Act 16). In the first embodiment, the processes of Act 13 through Act 15 are defined as the second wipe off step. When the count value exceeds time T3, the control circuit 15 instructs the pressure adjustment unit 76 to decompress (Act 17). The pressure adjustment unit 76 executes depressurization until it becomes a second negative pressure (−3.0 kPa) that is lower than the first negative pressure (Act 18). Until the count value by the timer 71 exceeds the preset time T4, the second negative pressure is maintained. In the first embodiment, the time from T3 to T4 is set to be 3 minutes.

During the time between T3 and T4, the highly viscous ink that remains on the nozzle surface is taken into the ink storage chamber 62 by the second negative pressure value. The highly viscous ink is carried to the second tank 52 by the circulation of the ink in the main flow path 35. The highly viscous ink and impurities are removed by the filter 43. In the first embodiment, the processes of Act 17 through Act 19 are defined as the ink suction step.

When the count value of the timer 71 exceeds time T4, the control circuit 15 instructs the pressure adjustment unit 76 to pressurize. The pressure adjustment unit 76 continues operation until the pressure sensor 75 senses pressure equal to the first negative pressure (Act 20). The control circuit 15 checks the number of times the maintenance mode from Act 1 to Act 20 has been activated (Act 21). In the first embodiment, the control circuit 15 is set to carry out the maintenance mode three times in a row. In the case where the number of times of execution of the maintenance mode is less than three times, the control circuit 15 executes Act 1. In the case where the number of times of execution of the maintenance mode is equal to or more than three times, the control circuit 15 halts the execution of the pump 36.

In the first embodiment, the maintenance mode re-dissolves highly viscous ink by supplying ink to the nozzle surface, and wipes the nozzle surface while maintaining the positive pressure of the inside of the nozzle plate 63. The foreign particle that adheres to the nozzle surface is removed without being sucked into the nozzle. Also, after wiping the nozzle surface, the ink inside the nozzle plate 63 is circulated with more than the usual amount of negative pressure being applied thereto. The highly viscous ink that has begun to be re-dissolved is pulled closer to the internal circulation path, and in the end is recovered by ink recirculation. Compared to carrying out ink circulation by negative pressure alone, the maintenance time is shortened.

Each of the units mentioned above is controlled by hardware circuits, such as ASIC, and the like. It is also possible for a program that is executed by the CPU inside the controller to control at least some of the units mentioned above.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet recording device comprising:

an inkjet head that is equipped with a nozzle for discharging ink;

a flow path configured to supply ink to the inkjet head;

a pressure adjustment unit configured to adjust a pressure inside the flow path;

a maintenance unit configured to wipe the nozzle of the inkjet head; and a controller configured to execute a maintenance mode of the inkjet head by controlling the pressure adjustment unit and the maintenance unit, wherein the controller in the maintenance mode is configured to:

control the maintenance unit to wipe the nozzle of the inkjet head after the pressure adjustment unit adjusts the pressure inside the flow path to a first positive pressure, and then control the maintenance unit to wipe the nozzle of the inkjet head again after the pressure adjustment unit adjusts the pressure inside the flow path to a first negative pressure, and control the pressure adjustment unit to adjust the pressure inside the flow path to a second negative pressure that is smaller than the first negative pressure.

2. The inkjet recording device according to claim 1, further comprising:

a roller configured to apply ink to the nozzle.

3. The inkjet recording device according to claim 2, wherein the controller is configured to activate the roller before the pressure adjustment unit adjusts the pressure inside the flow path to the first positive pressure.

4. The inkjet recording device according to claim 1, wherein:

the flow path includes a first tank, a second tank, a first ink flow path between the first tank and the inkjet head, a second ink flow path between the inkjet head and the second tank, and a third ink flow path between the second tank and the first tank.

5. The inkjet recording device according to claim 4, further comprising:

a first pressure sensor that is positioned in the first ink flow path and detects the pressure inside the first ink flow path, and a second pressure sensor that is positioned in the second ink flow path and detects the pressure inside the second flow path, wherein the controller is configured to determine an intermediate pressure of pressure detected by the first pressure sensor and pressure detected by the second pressure sensor as the pressure inside the flow path.

6. The inkjet recording device according to claim 4, further comprising:

a pump that is positioned in the third ink flow path to cause ink to be supplied from the second tank to the first tank, wherein the control unit is configured to operate the pump while executing the maintenance mode.

7. The inkjet recording device according to claim 4, wherein the inkjet head is positioned at a location that is higher than a location of the first tank and a location of the second tank.

8. The inkjet recording device according to claim 1, wherein the first positive pressure is higher than an atmospheric pressure.

9. The inkjet recording device according to claim 1, wherein the first negative pressure is equal to a pressure inside the flow path at a time when a printing operation is being executed by the inkjet head.

10. The control method according to claim 9, further comprising:

adjusting the pressure applied the ink inside the flow path so as to be equal to the first negative pressure before printing operation is executed by the inkjet head.

11. A control method for an inkjet recording device having an inkjet head that is equipped with a nozzle for discharging ink, comprising:

adjusting a pressure applied to ink inside a flow path that supplies ink to the inkjet head to a first positive pressure;

wiping a surface of the nozzle;

adjusting the pressure applied to the ink inside the flow path to a first negative pressure;

wiping the surface of the nozzle; and adjusting the pressure applied to the ink inside the flow path to a second negative pressure that is smaller than the first negative pressure.

12. The control method according to claim 11, further comprising:

supplying ink to the nozzle before the pressure applied to the ink that is supplied to the inkjet head is adjusted to the first positive pressure.

13. The control method according to claim 11, wherein the inkjet head is connected to a circulation route comprising a first tank, a second tank, a first ink flow path between the first tank and the inkjet head, a second ink flow path between the recording head and the second tank, and a third ink flow path between the second tank and the first tank.

14. The control method according to claim 13, further comprising:

calculating an intermediate value of an output value of a first pressure sensor that detects a pressure inside the first ink flow path, and an output value of a second pressure sensor that detects a pressure inside the second ink flow path, as the pressure applied to the ink.

15. The control method according to claim 12, further comprising:

driving a pump that is placed in the third ink flow path to cause ink to be supplied from the second tank to the first tank before adjusting the pressure applied to the ink to the first positive pressure.

16. The control method according to claim 11, wherein the first positive pressure is higher than an atmospheric pressure.

17. An inkjet recording device comprising:

an inkjet head having an ink discharge nozzle;

an ink flow path to the inkjet head;

a pressure adjustment valve installed along the ink flow path;

a maintenance unit configured to wipe the ink discharge nozzle; and a controller configured to:

control the pressure adjustment valve to adjust the pressure inside the flow path to a first positive pressure and then cause the maintenance unit to wipe the ink discharge nozzle, and control the pressure adjustment valve to adjust the pressure inside the flow path to a first negative pressure and then cause the maintenance unit to wipe the ink discharge nozzle, and control the pressure adjustment valve to adjust the pressure inside the flow path to a second negative pressure that is smaller than the first negative pressure.

18. The inkjet recording device according to claim 17, wherein the first positive pressure is greater than an atmospheric pressure.

19. The inkjet recording device according to claim 18, further comprising a pump configured to increase the pressure inside the flow path.

20. The inkjet recording device according to claim 19, wherein the first negative pressure is equal to a pressure inside the flow path at a time when a printing operation is being executed by the inkjet head.

* * * * *